US006010347A

United States Patent [19]

Lee

[11] Patent Number: 6,010,347

[45] Date of Patent: Jan. 4, 2000

[54] UNIVERSAL ELECTRIC SOCKET

[76] Inventor: Chiu-Shan Lee, No. 23, Lane 19, Chang-Chun Rd., Hsintien City, Taiwan

[21] Appl. No.: 09/165,498

[22] Filed: Oct. 2, 1998

[51] Int. Cl.[7] ..... H01R 19/42

[52] U.S. Cl. ..... 439/222; 439/441; 439/107; 439/934

[58] Field of Search ..... 439/107, 106, 439/222, 223, 650, 441, 934, 217

[56] References Cited

U.S. PATENT DOCUMENTS 5,007,848 4/1991 Lee ..... 439/101
5,836,777 11/1998 Chen ..... 439/222

*Primary Examiner*—Neil Abrams
*Attorney, Agent, or Firm*—Rosenberg, Klein & Lee

[57] ABSTRACT

A universal electric socket includes an insulative bottom shell having a pair of spaced ribs defining three separated chambers and three downwardly extending protruding portions below the chambers. An insulative cover shell covers the bottom shell so that the chambers are electrically insulated from one another. The cover may include ribs that interfit with the ribs of the bottom shell's ribs to isolate contacts disposed in the chambers. A grounding contact plate and two blade contact plates are respectively mounted in the chambers of the bottom shell. The grounding contact plate and the blade contact plates each have a plurality of receiving portions for receiving the grounding prong or blades of any of a variety of electric plugs. The blade contact plates each have a receiving portion and a wire clamp fastened to the receiving portion for holding the hot or neutral wire. Terminal blocks are respectively mounted in the protruding portions of the bottom shell and are respectively connected to the grounding contact plate and the blade contact plates. The terminal blocks each have a wire hole for receiving a wire, and a screw hole and a screw threaded into the screw hole for holding a wire. Thus, each of the contacts include both screw type clamps and wire push-in clamps for selective use.

7 Claims, 5 Drawing Sheets

UNIVERSAL ELECTRIC SOCKET

BACKGROUND OF THE INVENTION

The present invention relates to electric sockets, and more specifically to a universal electric socket for test purpose which can be used with any of a variety of electric plugs.

A regular electric socket is designed for receiving an electric plug of a particular specification. This structure of electric socket has sufficient space to electrically insulatively separate the grounding metal plate and blade contact metal plates from one another, and to prevent a high voltage short circuit between the blade contact metal plates. There are known electric sockets designed for receiving any of different electric plugs of different specifications. However, in order to prevent a high voltage short circuit between the blade contact metal plates, thick partition walls must be provided to electrically insulatively separate the grounding metal plate and blade contact metal plates from one another. Further, in electric appliance factories that fabricate electric appliance of different specifications for different countries, a set of electric sockets are provided for testing the power circuit of fabricated electric appliance. These electric sockets for test purpose occupy much installation space in the fabrication line.

SUMMARY OF THE INVENTION

The present invention has been accomplished under the circumstances in view. It is one object of the present invention to provide a universal electric socket for test purpose which can be used with any of a variety of electric plugs of different specifications. It is another object of the present invention to provide a universal electric socket which effectively prohibits a high voltage short circuit between the positive terminal and the negative terminal. According to one aspect of the present invention, the universal electric socket includes an insulative bottom shell defining three separated top chambers and three downwardly protruded protruding portions below the top chambers, an insulative cover shell covered on the bottom shell to keep the top chambers be electrically insulated from one another, a grounding metal plate and two blade contact metal plates respectively mounted in the top chambers inside the bottom shell, the grounding metal plate and the blade contact metal plates each having a plurality of receiving portions for receiving the grounding prong or blades of any of a variety of electric plugs, the blade contact metal plates each having a receiving portion and a wire clamp fastened to the receiving portion for holding the hot or neutral wire of an electric wire, a first metal terminal block and two second metal terminal blocks respectively mounted in the protruding portions of the bottom shell and respectively connected to the grounding metal plate and the blade contact metal plates, the first metal terminal block and second metal terminal blocks each having a wire hole for receiving the grounding wire, neutral wire or hot wire of an electric wire, a screw hole extended from the wire hole to the outside, and a tightening up screw threaded into the screw hole for holding down the grounding wire, hot wire or neutral wire of an electric wire in position. According to another aspect of the present invention, the bottom shell has two parallel partition walls that separate the middle chamber and side chambers from one another, each partition wall having a top coupling flange, and the cover shell has two longitudinal bottom ribs raised from the bottom side wall thereof, each bottom rib having a coupling groove respectively engaged with the coupling flanges of the partition walls of the bottom shell.

According to still another aspect of the present invention, the blade contact metal plates each have a retaining portion, and a wire clamp fastened to the retraining portion for holding the hot or neutral wire of an electric wire.

DETAILED DESCRIPTION OF THE PREFERRED EMBODIMENT

Figure 1:
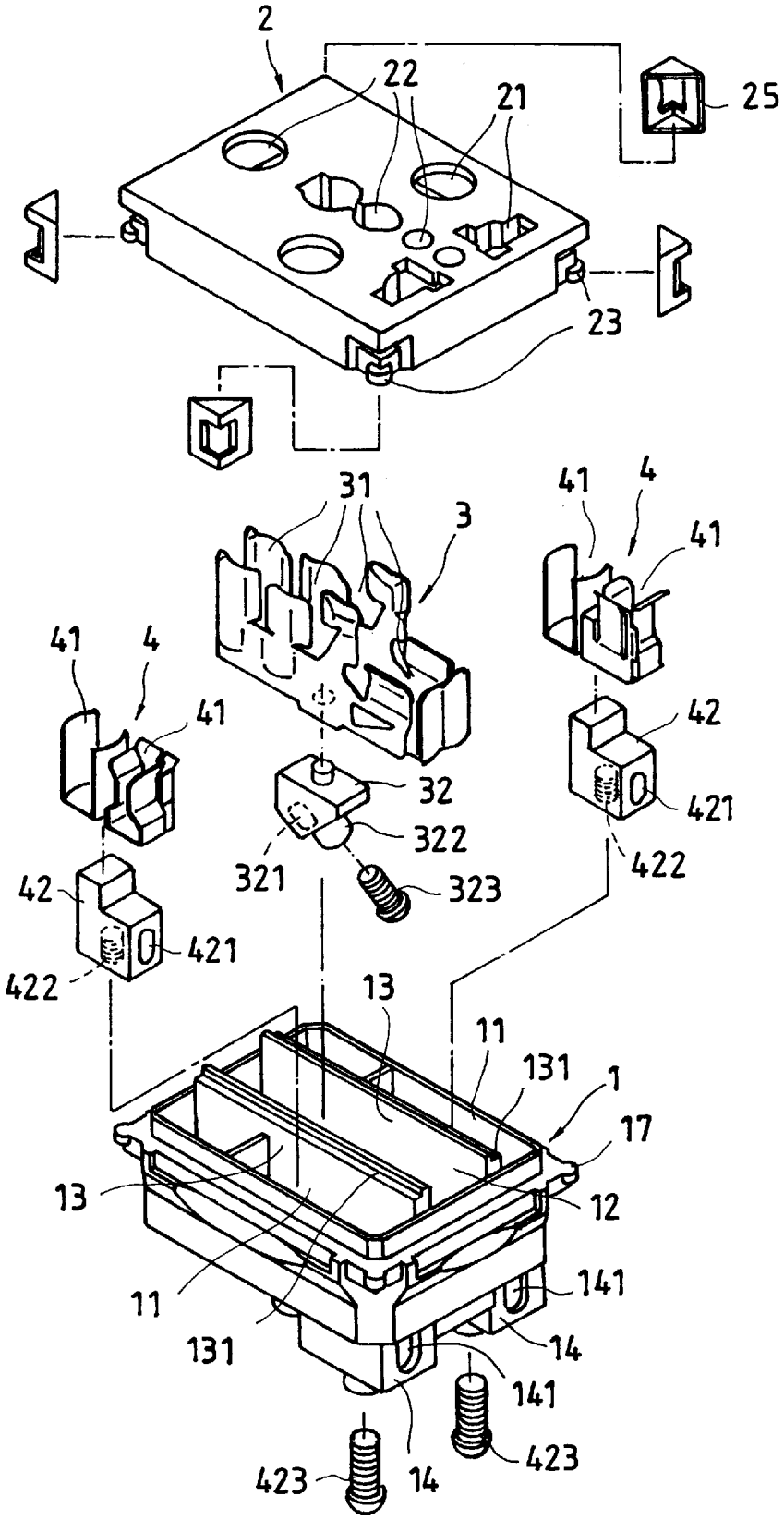
FIG. 1 is an exploded view of a universal electric socket according to a first embodiment of the present invention.
Figure 3:
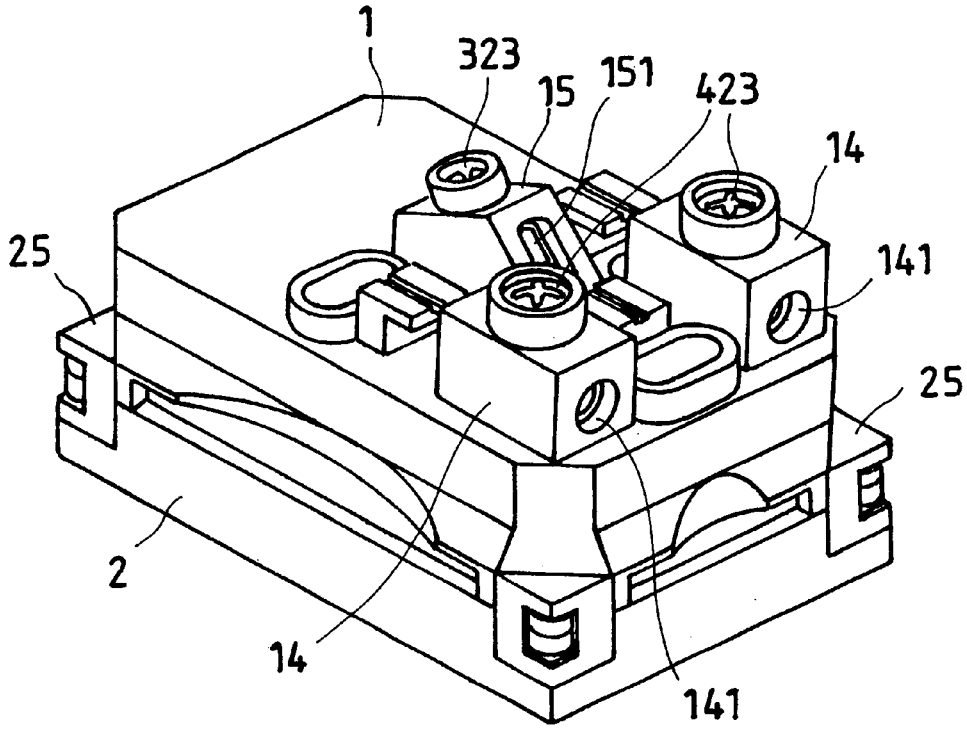
FIG. 3 is a perspective back side view of the universal electric socket according to the first embodiment of the present invention.
Figure 2:
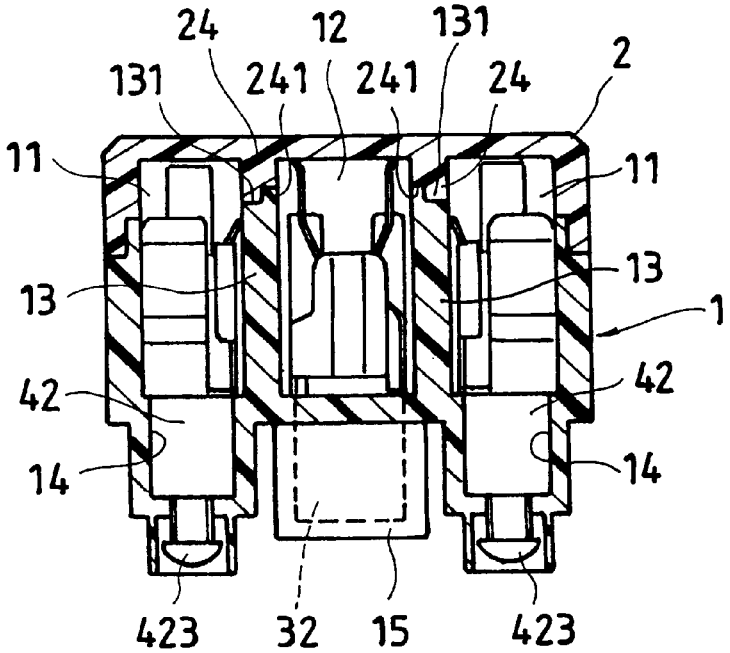
FIG. 2 is a sectional assembly view of the universal electric socket according to the first embodiment of the present invention.

Referring to FIGS. 1, 2 and 3, a universal electric socket according to one embodiment of the present invention is shown comprised of an electrically insulative bottom shell 1, and an electrically insulative cover shell 2 covered on the bottom shell 1. The bottom shell 1 comprises two longitudinal partition walls 13 arranged in parallel, a middle chamber 12 defined between the partition walls 13, two symmetrical side chambers 11 separated by the partition walls 13 at two opposite sides of the middle chamber 12. Two blade contact metal plates 4 are respectively mounted in the side chambers 11 inside the bottom shell 1, each having a set of blade receiving portions 41 for receiving the blades of any of a variety of electric plugs. A grounding metal plate 3 is mounted in the middle chamber 12 inside the bottom shell 1, having a set of grounding prong receiving portions 31 for receiving the grounding prong of any of a variety of electric plugs. The height of the partition walls 13 is greater than the height of the grounding metal plate 3 and the blade contact metal plates 4. The cover shell 2 comprises a set of grounding prong insertion holes 22 and symmetrical sets of blade insertion holes 21 at two opposite sides of the grounding prong insertion holes 22 for receiving the blades and grounding prong of any of a variety of electric plugs. The bottom shell 1 and the cover shell 2 have respective projecting coupling portions 23,17 in corners. The blade insertion holes 21 include a set of round blade insertion holes for receiving the round blades of an electric plug of South Africa's specifications, and a set of combination holes, each combination hole formed of two perpendicularly connected rectangular holes and a round hole integral with one rectangular hole on the middle. When the cover shell 2 is covered on the bottom shell 1, clamps 25 are fastened to the projecting coupling portions 17,23 of the shells 1,2 to secure the bottom shell 1 and the cover shell 2 firmly together. The cover shell 2 comprises two longitudinal bottom ribs 24 raised from the bottom side wall thereof corresponding to the partition walls 13, each having a coupling groove 241 longitudinally disposed along the length. The partition walls 13 of the bottom shell 1 each have a top coupling flange 131 longitudinally disposed along the length and respectively engaged into the coupling grooves 241 at the longitudinal bottom ribs 24 of the cover shelf 2. When the bottom shell 1 and the cover shell 2 are fastened together, the partition walls 13 and the bottom ribs 24 are respectively air-tightly matched together to prohibit high voltage (about 8 KV) from passing between the blade contact metal plates 4 and the grounding metal plate 3. The bottom shell 1 further comprises a downwardly protruded first protruding portion 15 and two downwardly protruded second protruding portions 14 respectively disposed below the middle chamber 12 and the side chambers 11. The first protruding portion 15 has a wire hole 151 through which the grounding wire passes. The second protruding portions 14 each have a wire hole 141 through which the hot or neutral wire passes. A first metal terminal block 32 and two second metal terminal blocks 42 are respectively mounted in the first protruding portion 15 and second protruding portions 14 inside the bottom shell 1, and respectively connected to the grounding metal plate 3 and the blade contact metal plates 4. The metal terminal blocks 32,42 each have a wire bole 321 or 421, a screw hole 322 or 422 respectively extended from the wire hole 321 or 421 to the outside, and a tightening up screw 323 or 423 threaded into the screw hole 322 or 422 to hold down the grounding wire, hot wire or neutral wire in the wire hole 321 or 421.

Figure 4:
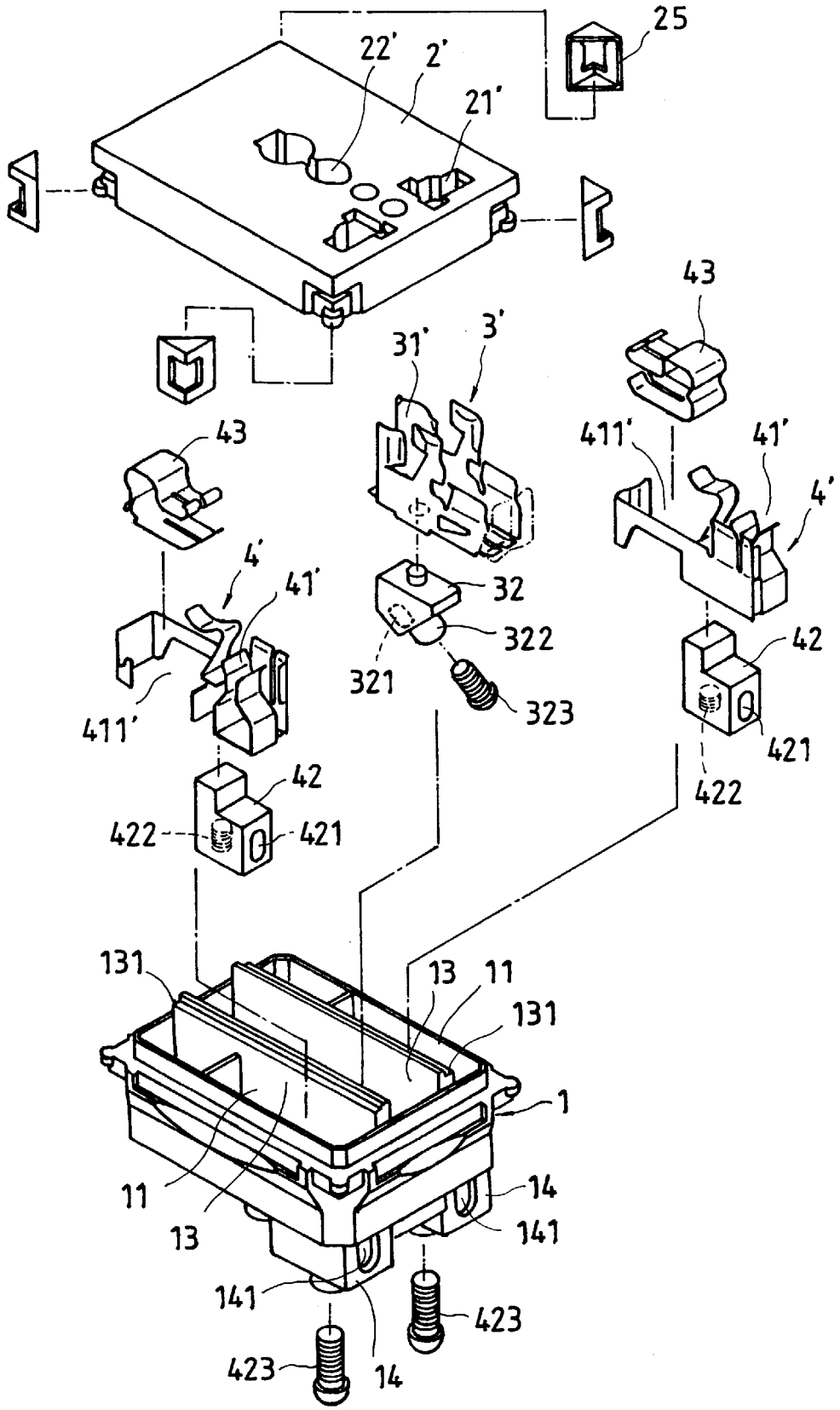
FIG. 4 is an exploded view of a universal electric socket according to a second embodiment of the present invention.
Figure 5:
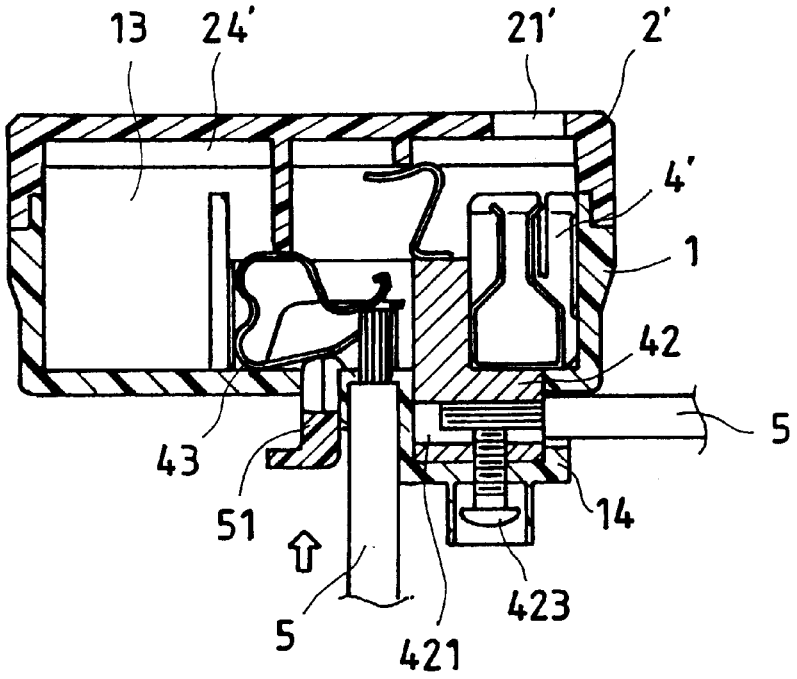
FIG. 5 is a sectional view of the second embodiment of the present invention, showing the connection of the hot/neutral wire to the blade contact metal plate.
Figure 6:
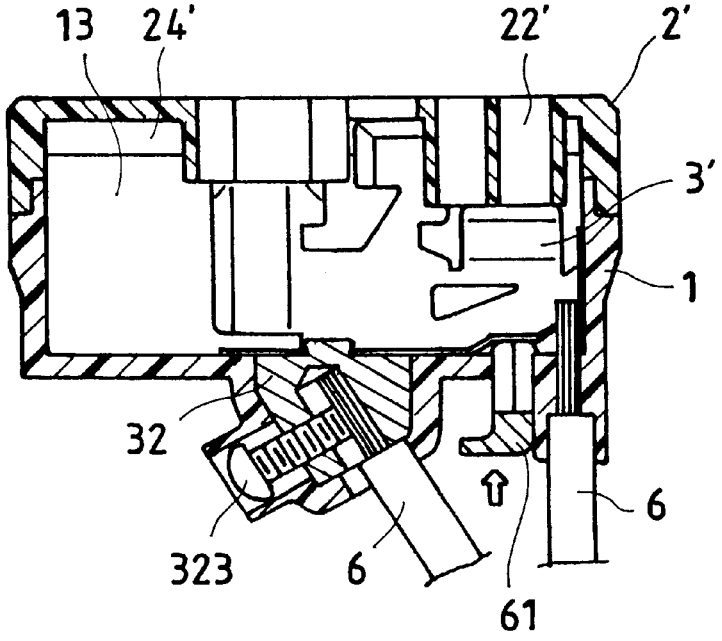
FIG. 6 is a sectional view of the second embodiment of the present invention, showing the connection of the grounding wire to the grounding metal plate.

FIGS. 4, 5 and 6 show a universal electric socket according to a second embodiment of the present invention. According to this second embodiment, the universal electric socket is comprised of a bottom shell 1, a cover shell 2' covered on the bottom shell 1, one first metal terminal block 32 and two second metal terminal blocks 42 respectively mounted in the downwardly protruded first protruding portion 15 and two downwardly protruded second protruding portions 14 of the bottom shell 1, a grounding metal plate 3' and two blade contact metal plates 4' respectively mounted in the middle chamber 12 and side chambers 11 inside the bottom shell 1 and respectively connected to the metal terminal blocks 32,42. The metal terminal blocks 32,42 each have a wire bole 321 or 421, a screw hole 322 or 422 respectively extended from the wire hole 321 or 421 to the outside, and a tightening up screw 323 or 423 threaded into the screw hole 322 or 422 to hold down the grounding wire, hot wire or neutral wire in the wire hole 321 or 421. The cover shell 2' and the bottom shell 1 are fastened together by clamps 25. The cover shell 2' comprises a set of grounding prong insertion holes 22 and two symmetrical blade insertion holes 21 at two opposite sides of the grounding prong insertion holes 22 for receiving the grounding prong and blades of any of a variety of electric plugs. The partition walls 13 of the bottom shell 1 which separate the side cambers 11 from the middle chamber 12 each have a top coupling flange 131 longitudinally disposed along the length and respectively engaged into the coupling grooves 241' at the longitudinal bottom ribs 24' (not shown) of the cover shell 2'. The grounding metal plate 3' has a grounding prong receiving portion 31' for receiving the grounding prong of any of a variety of electric plugs. The blade contact metal plates 4' each have a blade receiving portion 41', a retaining portion 411', and a wire clamp 43 fastened to the retaining portion 411'. When connecting to a two-line electric wire 5, the user can selectively fasten the hot and neutral wires of the two-line electric wire 5 to the second metal terminal blocks 42 or the wire clamps 43. The wires can be released from the wire clamps 43 by depressing the members 51 associated with each blade contact metal plate 4'. The grounding wire 6 can be selectively fastened to the terminal block 32 or a wire clamp portion of the grounding metal plate 3'. The grounding wire 6 can be released from the wire clamp portion of the grounding metal plate 3' by depressing the member 61. This second embodiment cannot be used with an electric plug of South Africa' specifications.

Figure 7:
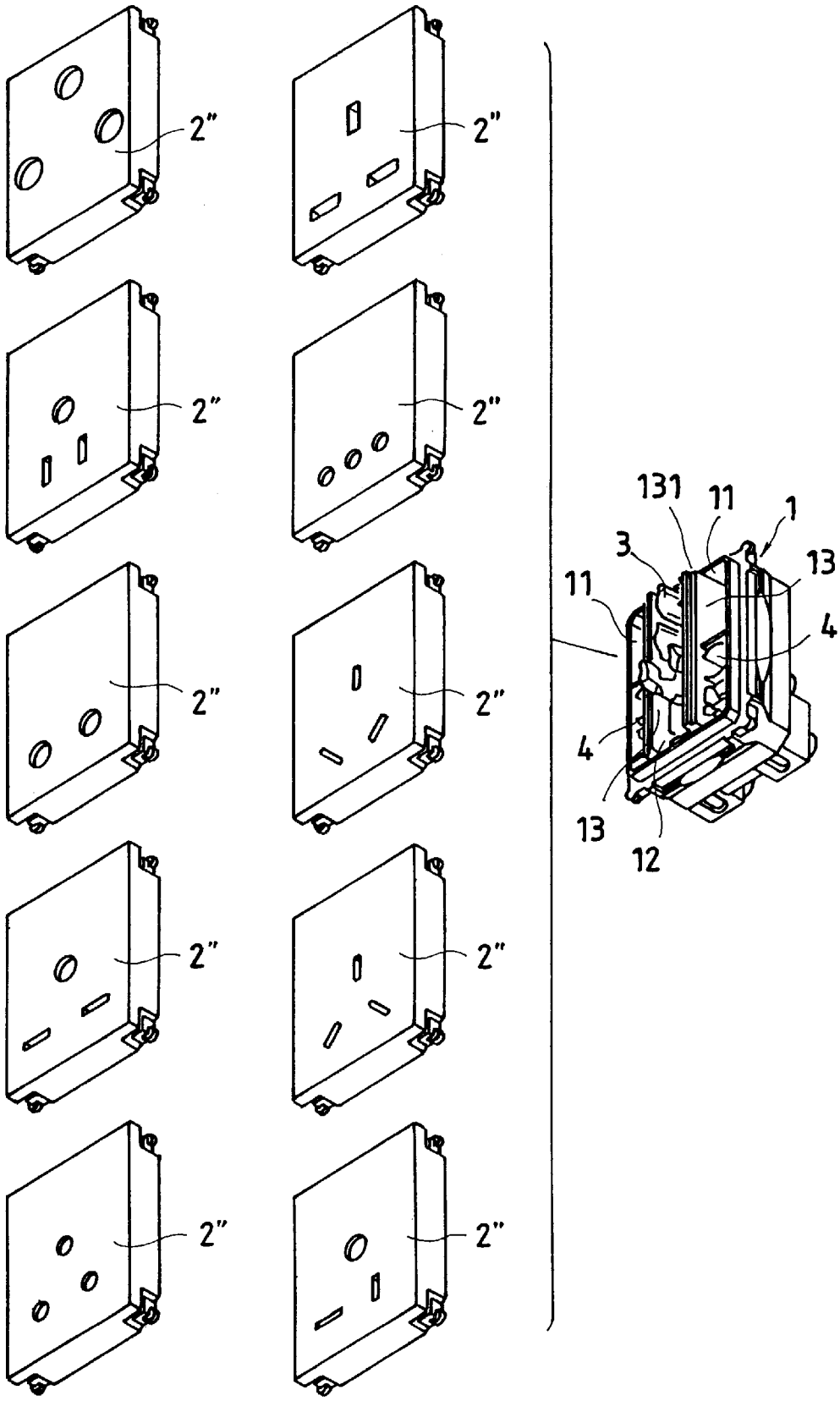
FIG. 7 shows a set of cover shells for selective use with the bottom shell according to the present invention.

Referring to FIG. 7, any of a variety of cover shells 2" for different electric plugs may be selectively used and covered on the bottom shell 1 instead of the cover shell 2 of the aforesaid first embodiment or the cover shell 2' of the aforesaid second embodiment.

It is to be understood that the drawings are designed for purposes of illustration only, and are not intended as a definition of the limits and scope of the invention disclosed. For example, release button means may be provided, and controlled to release the electric wire from the wire clamps at the blade contact metal plates.

What the invention claimed is:

1. A universal electric socket comprising:

an electrically insulative bottom shell, said bottom shell comprising two longitudinal partition walls arranged in parallel, a middle chamber defined between said partition walls, two symmetrical side chambers separated by said partition walls at two opposite sides of said middle chamber, a downwardly protruded first protruding portion disposed below said middle chamber, and two downwardly protruded second protruding portions respectively disposed below said side chambers, said first protruding portion and said second protruding portions each having a wire hole extended to the outside of said bottom shell;

an electrically insulative cover shell covered on said bottom shell, said cover shell comprising a set of grounding prong insertion holes longitudinally arranged on the middle for receiving the grounding prong of one of a set of electric plugs of different specifications, and a set of blade insertion holes symmetrically disposed at two opposite sides of said grounding prong insertion holes for receiving the blades of one of a set of electric plugs of different specifications;

a first metal terminal block and two second metal terminal blocks respectively mounted in the first protruding portion and second protruding portions of said bottom shell, said first metal terminal block and second metal terminal blocks each having a wire hole for receiving the grounding wire, neutral wire or hot wire of an electric wire, a screw bole extended from said wire hole to the outside, and a tightening up screw threaded into said screw hole for holding down the grounding wire, hot wire or neutral wire of an electric wire in position;

a grounding metal plate mounted in the middle chamber of said bottom shell and connected to said first metal block, said grounding metal plate having a plurality of grounding terminal receiving portions for receiving the grounding prong of one of a set of electric plugs of different specifications; and two blade contact metal plates respectively mounted in the side chambers of said bottom shell and connected to said second metal blocks, said blade contact metal plates each having a plurality of blade receiving portions for receiving the blades of one of a set of electric plugs of different specifications.

2. The universal electric socket of claim 1 wherein said cover shell comprises two longitudinal bottom ribs raised from a bottom side wall thereof corresponding to the partition walls of said bottom shell, said longitudinal bottom ribs each having a coupling groove; the partition walls of said bottom shell each have a top coupling flange respectively engaged into the coupling grooves at the longitudinal bottom ribs of said cover shell to electrically isolate said blade contact metal plates from each other.

3. The universal electric socket of claim 2 wherein the height of said partition walls is greater than the height of said grounding metal plate and said blade contact metal plates.

4. The universal electric socket of claim 1 wherein the blade insertion holes of said cover shell include a set of round blade insertion holes for receiving the round blades of an electric plug of South Africa's specifications, and a set of combination holes, said combination holes each formed of two perpendicularly connected rectangular holes and a round hole integral with one rectangular hole on the middle.

5. The universal electric socket of claim 1 wherein said bottom shell comprises a plurality of projecting coupling portions respectively raised from the periphery in four corners thereof, and said cover shell comprises a plurality of projecting coupling portions respectively raised from the periphery in four corners thereof and respectively fastened to the projecting coupling portions of said bottom shell by a respective clamp.

6. The universal electric socket of claim 1 wherein said blade contact metal plates each have a retaining portion, and a wire clamp fastened to said retaining portion for holding the hot wire or neutral wire of an electric wire.

7. The universal electric socket of claim 6 further comprising release button means controlled to release the electric wire from the wire clamps at said blade contact metal plates.

* * * * *